US008592125B2

(12) United States Patent
Teshima

(10) Patent No.: US 8,592,125 B2
(45) Date of Patent: Nov. 26, 2013

(54) LIQUID DEVELOPER AND IMAGE FORMING METHOD

(75) Inventor: Takashi Teshima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 305 days.

(21) Appl. No.: 12/708,390

(22) Filed: Feb. 18, 2010

(65) Prior Publication Data

US 2010/0233614 A1 Sep. 16, 2010

(30) Foreign Application Priority Data

Mar. 16, 2009 (JP) ..... 2009-063555

(51) Int. Cl.
*G03G 9/13* (2006.01)

(52) U.S. Cl.
USPC ..... 430/114; 430/115; 430/137.22

(58) Field of Classification Search
USPC ..... 430/114, 115, 137.22
See application file for complete search history.

(56) References Cited

U.S. PATENT DOCUMENTS

| | | | | |
|---|---|---|---|---|
| 3,493,414 | A * | 2/1970 | Hastings | 428/151 |
| 3,907,693 | A * | 9/1975 | Tamai et al. | 430/114 |
| 5,700,395 | A * | 12/1997 | Thetford et al. | 516/31 |
| 7,566,520 | B2 | 7/2009 | Miura et al. | |
| 7,635,550 | B2 | 12/2009 | Teshima | |
| 2009/0016766 | A1 * | 1/2009 | Kamijo et al. | 399/101 |
| 2010/0014894 | A1 * | 1/2010 | Ueno et al. | 399/233 |
| 2010/0055602 | A1 * | 3/2010 | Teshima | 430/114 |

FOREIGN PATENT DOCUMENTS

| | | |
|---|---|---|
| JP | 57-056853 | 4/1982 |
| JP | 05-061264 | 3/1993 |
| JP | 05-072817 | 3/1993 |
| JP | 09-114340 | 5/1997 |
| JP | 2000-019787 | 1/2000 |
| JP | 2006-251252 | 9/2006 |
| JP | 2007-041163 | 2/2007 |
| JP | 2009-014808 | 1/2009 |
| JP | 2009-258591 | * 11/2009 |

OTHER PUBLICATIONS

Translation of JP 2009-258591 published Nov. 2009.*
Codex Alimentarius vol. 8: Codex Standard for Named Vegetable Oils, published Jan. 1991.*

* cited by examiner

*Primary Examiner* — Peter Vajda
(74) *Attorney, Agent, or Firm* — Workman Nydegger

(57) ABSTRACT

Provided is a liquid developer containing toner particles and an insulating liquid containing an epoxy modified fatty acid alkyl ester.

16 Claims, 2 Drawing Sheets

1000

LIQUID DEVELOPER AND IMAGE FORMING METHOD

CROSS-REFERENCE TO RELATED APPLICATION

The entire disclosure of Japanese Patent Application No. 2009-063555, filed Mar. 16, 2009 is expressly incorporated by reference herein.

BACKGROUND

1. Technical Field

The present invention relates to a liquid developer and an image forming method.

2. Related Art

In using developers used for developing an electrostatic latent image formed on a latent image carrier, there are a method using a dry toner in which a toner constituted with a material including a coloring agent such as a pigment and a binder resin is used in a dry state, and a method in which a liquid developer is used by dispersing a toner in a carrier liquid having an electrical insulation property (an insulating liquid).

The method using a dry toner has an advantage in treatment because the toner is handled in a solid state, but has problems in that there are concerns about adverse effects to the human body caused by the powder, flying toner particles causing contamination, and the toner particles not being uniformly dispersed. In addition, with the dry toner, there are problems that the toner particles easily clump together, it is difficult to make the size of the toner particles sufficiently small, and it is difficult to form a toner image with a high resolution. Moreover, when the size of the toner particles is relatively small, the problems caused by the powdery state as described above become more evident.

On the other hand, the method using a liquid developer enables the use of fine toner particles because the clumping of the toner particles in the liquid developer is effectively prevented, and the method can use a liquid developer having a lower softening point (low softening temperature) than a resin material used in a dry toner as a binder resin. As a result, the method using the liquid developer is excellent in reproducibility of a fine line image, reproducibility of a grayscale, reproducibility of colors, and a high speed image forming method.

However, an insulating liquid that has been used in a liquid developer in the related art mainly includes a petroleum-based hydrocarbon. In such a liquid developer, the insulating liquid adheres onto the surface of the toner particles during fixing. In the liquid developer in the related art, the insulating liquid adhering to the surface of the toner particles deteriorates fixing intensity, and thereby it is not possible to obtain a sufficiently satisfactory fixing property.

In order to solve the problem, there was an attempt to improve the fixing intensity by an oxidative polymerization reaction of a fat during the fixing, using a fat derived from the nature such as vegetable oil as the insulating liquid (JP-A-2006-251252).

However, even when the fat as above was used, it was not possible to obtain sufficient fixing intensity.

SUMMARY

An advantage of some aspects of the invention is that it provides a liquid developer excellent in a fixing property of toner particles to a recording medium and in preservation stability, and an image forming method using the liquid developer.

According to an aspect of the invention, there is provided a liquid developer including toner particles, and an insulating liquid containing an epoxy modified fatty acid alkyl ester.

According to the above aspect of the invention, there is provided a liquid developer in which the concentration of an oxirane oxygen of the epoxy modified fatty acid alkyl ester is from 1 to 25%.

According to the above aspect of the invention, there is provided a liquid developer in which the epoxy modified fatty acid alkyl ester is composed of an epoxy modified fatty acid component having a carbon number of 6 to 22, and an alcohol component having a carbon number of 2 to 18.

According to the above aspect of the invention, there is provided a liquid developer in which the surfaces of the toner particles are modified with polyalkyleneimine.

According to the above aspect of the invention, there is provided a liquid developer in which the weight-average molecular weight of the polyalkyleneimine is from 10,000 to 70,000.

According to the above aspect of the invention, there is provided a liquid developer in which the polyalkyleneimine is a polyethyleneimine.

According to the above aspect of the invention, there is provided a liquid developer in which the toner particles contain a resin material including a rosin-based resin.

According to another aspect of the invention, there is provided an image forming method which includes developing images by using a plurality of liquid developers having different colors to form a plurality of monochromatic images corresponding to the plurality of liquid developers, transferring the plurality of monochromatic images corresponding to each color to a recording medium to form an unfixed toner image thereon by superimposing the plurality of monochromatic images, and fixing the unfixed toner image on the recording medium. In the image forming method, the liquid developers contain toner particles and an insulating liquid including an epoxy modified fatty acid alkyl ester.

According to the above aspect of the invention, there is provided an image forming method in which the fixing temperature when the unfixed toner image is to be fixed is from 80 to 160° C. during the fixing.

With the above described configurations, it is possible to provide a liquid developer excellent in its property of fixing toner particles to a recording medium, and in preservation stability, and an image forming method using the liquid developer.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
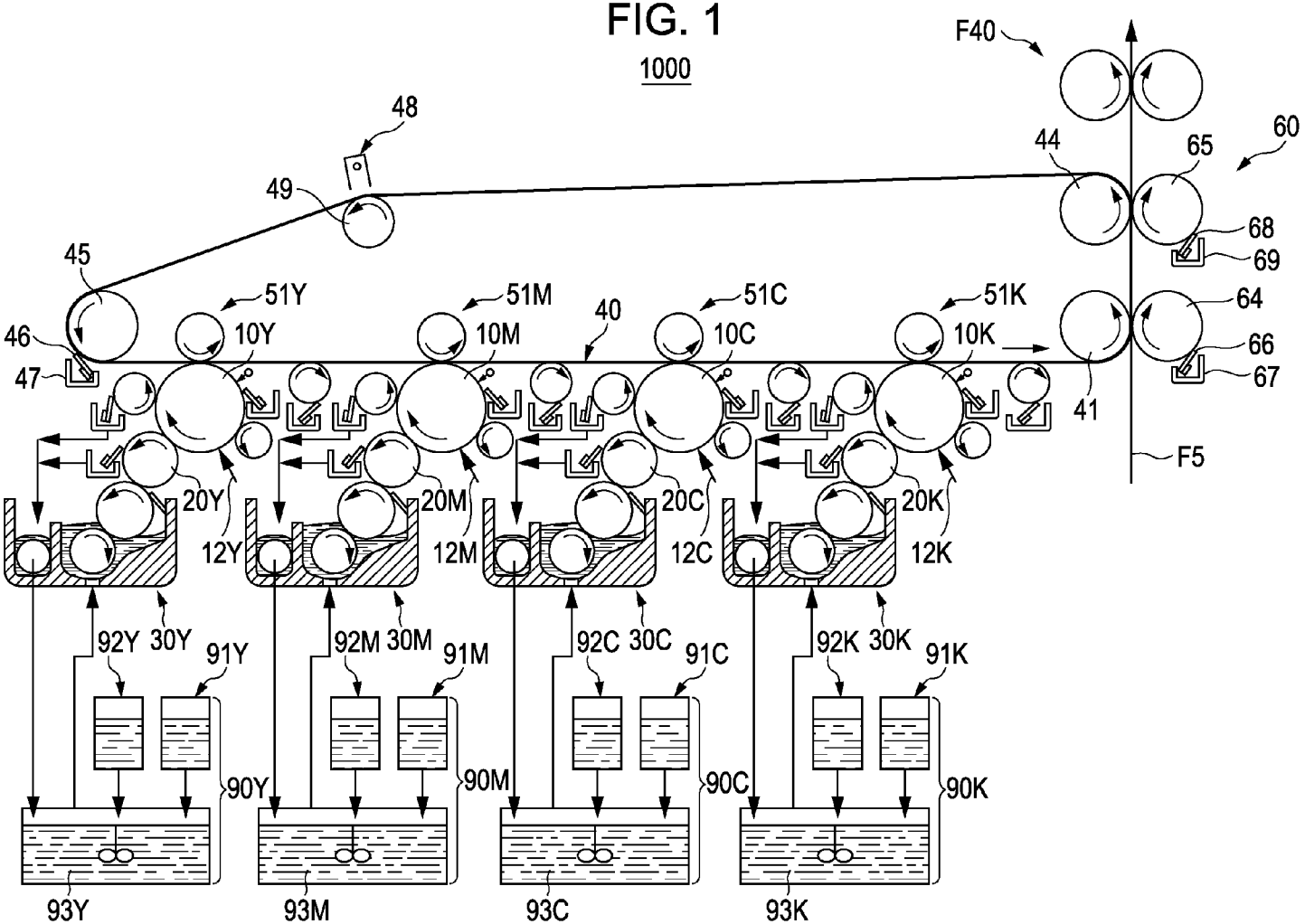
FIG. 1 is a schematic diagram illustrating an example of an image forming apparatus to which the image forming method of the invention is applied.

Hereinafter, exemplary embodiments of the invention will be described in detail.

Liquid Developer

First, the liquid developer of the invention will be described. The liquid developer of the invention includes an insulating liquid in which toner particles are dispersed as described below.

Hereinafter, components that constitute the liquid developer will be described in detail.

Insulating Liquid

First, an insulating liquid will be described.

The insulating liquid constituting the liquid developer of the invention includes an epoxy modified fatty acid alkyl ester.

The epoxy modified fatty acid alkyl ester is a fatty acid alkyl ester having a three-membered ring called an epoxy group (oxirane ring) in the molecular structure and is a liquid state compound having a high insulation property which can be used as an insulating liquid for a liquid developer.

The epoxy modified fatty acid alkyl ester is a compound in which at least a part of a double bond of carbons (C=C) in an unsaturated fatty acid alkyl ester is modified to an epoxy group.

However, in the liquid developer, when the toner particles are to fix to a recording medium, the insulating liquid adheres to the surface of the toner particles. The liquid developer in the related art had a problem that the existence of the insulating liquid adhering to the surface of the toner particles hinders the fixing property of the toner particles to the recording medium (the fixing strength is lowered).

Contrary to that, the liquid developer of the invention is excellent in the fixing strength of the toner particles to the recording medium by using the insulating liquid containing an epoxy modified fatty acid alkyl ester. This conclusion can be reached based on the following reasons.

The epoxy modified fatty acid alkyl ester is a component having high affinity for a recording medium such as paper. Accordingly, the epoxy modified fatty acid alkyl ester adhering to around the surface of the toner particles swiftly infiltrates into the recording medium when the toner particles come into contact with the recording medium during a fixing. With the swift infiltration, the epoxy modified fatty acid alkyl ester does not hinder the fixing property of the toner particles to the recording medium, but enables the toner particles to strongly fix onto the recording medium. In addition to the infiltration of the epoxy modified fatty acid alkyl ester, some of the toner particles that are melted by heat during the fixing infiltrate the recording medium and bring about the anchor effect, and thereby improving the fixing property of the toner particles to the recording medium such as paper.

Furthermore, the epoxy modified fatty acid alkyl ester is a component in which deterioration (such as oxidation, and dissolution) hardly occurs. For this reason, the insulating liquid containing such epoxy modified fatty acid alkyl ester is assuredly prevented from deterioration phenomena including an increase in viscosity, discoloration, a decrease in electric resistance values, and the like for a long period of time, and thereby particularly excellent in the preservation stability of the liquid developer. In addition, during the fixing, the epoxy modified fatty acid alkyl ester is transferred to the paper together with the toner particles, and thereby the epoxy modified fatty acid alkyl ester is included in the formed toner image. The epoxy modified fatty acid alkyl ester is a component that hardly deteriorates, and the toner image formed therewith is reliably prevented from discoloration even when being exposed to external environments (such as light, heat, oxygen), and therefore, the formed toner image keeps clear over a long period of time.

The carbon number of the epoxy modified fatty acid component in the epoxy modified fatty acid alkyl ester is preferably from 6 to 22, and more preferably from 10 to 18. When the carbon number of the epoxy modified fatty acid component is less than the lower limit, the carbon number of an alcohol component causes part of a material constituting the toner particles to be melted in the epoxy modified fatty acid alkyl ester, and thereby sufficient preservation stability may not be obtained. In addition, when the carbon number of the epoxy modified fatty acid component exceeds the upper limit, the carbon number of the alcohol component causes the viscosity of the epoxy modified fatty acid alkyl ester to increase, and thereby it may be difficult to use the epoxy modified fatty acid alkyl ester as a constituent component of the insulating liquid.

Furthermore, the carbon number of the alcohol component in the epoxy modified fatty acid alkyl ester is preferably from 2 to 18, and more preferably from 5 to 16. When the carbon number of the alcohol component is less than the lower limit, the carbon number of the epoxy modified fatty acid component causes the part of the material constituting the toner particles to be melted in the epoxy modified fatty acid alkyl ester, and thereby sufficient preservation stability may not be obtained. In addition, when the carbon number of the alcohol component exceeds the upper limit, the carbon number of the epoxy modified fatty acid component causes the viscosity of the epoxy modified fatty acid alkyl ester to increase, and thereby it may be difficult to use the epoxy modified fatty acid alkyl ester as a constituent component of the insulating liquid.

Furthermore, as the fatty acid component of the epoxy modified fatty acid alkyl ester, for example, a fatty acid component derived from vegetable oil such as canola oil, and soy bean oil is preferable. Accordingly, it is possible to have an appropriate carbon number of the epoxy modified fatty acid component and to further improve the preservation stability of the liquid developer.

Furthermore, the concentration of an oxirane oxygen of such epoxy modified fatty acid alkyl ester is preferably from 1 to 25%, more preferably from 2 to 20%, and still more preferably from 3 to 15%. Accordingly, it is possible to further enhance the infiltration property of the insulating liquid to the recording medium while the preservation stability of the liquid developer is improved. Moreover, the concentration of the oxirane oxygen is a value obtained by causing an oxirane ring to react with a hydrogen halide and calculating the amount of the hydrogen halide wasted in the ring-opening reaction.

Furthermore, the insulating liquid may include a component other than the epoxy modified fatty acid alkyl ester described above.

As for the component, for example, there are Isopar E, Isopar G, Isopar H, and Isopar L (Isopar is a trade name Exxon Mobil Corporation), Shellsol 70, and Shellsol 71 (Shellsol is a trade name of Shell Oil Company), Amsco OMS, and Amsco 460 solvent (Amsco is a trade name of American Mineral Spirits Corporation), mineral oil (hydrocarbon-based liquid) such as low viscosity/high viscosity liquid paraffin (Waco Pure Chemical Industries, Ltd.), vegetable oil containing fatty acid glyceride, medium-chain fatty acid ester, and the like, fatty acid monoester which is ester between fatty acid and monovalent alcohol, octane, isooctane, decane, isodecane, decalin, nonane, dodecane, isodecane, cyclohexane, cyclooctane, cyclodecane, benzene, toluene, xylene, mesitylene, and the like.

Furthermore, the content amount of the epoxy modified fatty acid alkyl ester in the insulating liquid is preferably from 5 to 100 wt %, more preferably from 10 to 80 wt %, and still more preferably from 20 to 60 wt %. When the content ratio of the epoxy modified fatty acid alkyl ester is within the above range, it is possible to make the insulating liquid infiltrate into the recording medium, and as a result, particularly excellent fixing strength can be obtained.

In addition, the electric resistance at room temperature (20° C.) of the insulating liquid is preferably $10^{11}$ Ωcm or more, and more preferably $10^{12}$ Ωcm or more, and still more preferably $10^{13}$ Ωcm or more.

Furthermore, the relative permittivity of the insulating liquid is preferably 3.5 or less.

The viscosity of the insulating liquid is not particularly limited, but preferably from 5 to 1000 mPa·s, more preferably from 50 to 800 mPa·s, and still more preferably from 50 to 500 mPa·s. When the viscosity of the insulating liquid is within the above range, in case where the liquid developer is pumped from a developer container to a coating roller, an appropriate amount of the insulating liquid adheres to the toner particles, and thereby it is possible to form an image at high speed, and to obtain a particularly excellent fixing property of the toner particle to the recording medium. However, the viscosity in the present specification indicates a value measured at 25° C.

Toner Particles

Next, the toner particles will be described.

Constituent Material of Toner Particles

The toner particles include at least a resin material and a coloring agent.

1. Resin Material (Binder Resin)

The toner particles are composed of a material including a resin material as a main component.

In the invention, the resin material (binder resin) is not particularly limited, but for example, known resins may be used. Among these, when a polyester resin is used, the aforementioned affinity of the toner particles for the epoxy modified fatty acid alkyl ester increases, and thereby it is possible to obtain an excellent dispersing property of the toner particles in the liquid developer. In addition, the polyester resin adequately infiltrates into the recording medium together with the infiltration of the epoxy modified fatty acid alkyl ester, and it is possible to improve the fixing strength of the toner particles. Moreover, the polyester resin has high transparency, and when it is used as a binder resin, it is possible to improve color development of an obtained image. Furthermore, since the polyester resin is a material having relatively a large amount of functional groups (acid group) with high reactivity with polyalkyleneimine to be described later, it is possible to perform appropriate surface modification with the polyalkyleneimine, and to further improve a charging characteristic of the liquid developer.

Furthermore, it is preferable that a resin material includes a rosin-based resin. Since the rosin-based resin has a high affinity with a recording medium such as paper, the fixing property of toner particles can be further improved. In addition, since the rosin-based resin has a high affinity with epoxy modified fatty acid alkyl ester, the epoxy modified fatty acid alkyl ester as well as the rosin-based resin can infiltrate the recording medium well, and the fixing strength of the toner particles can be further improved. Moreover, since the rosin-based resin is a material having a large amount of functional groups (acid groups) having a high reactivity with polyalkyleneimine to be described later, the surface modification with the polyalkyleneimine can be carried out more appropriately and the charging property of a liquid developer can be further enhanced.

As a rosin-based resin, for example, there are rosin modified phenol resin, rosin modified mullein resin, rosin modified polyester resin, fumaric modified rosin resin, and ester gum, and it is possible to use one kind or a combination of two or more kinds among them.

Furthermore, the weight-average molecular weight of the rosin-based resin is preferably from 500 to 100,000, and more preferably from 1,000 to 80,000, and still more preferably from 1,000 to 50,000. Accordingly, it is possible to make the fixing property of the toner particles compatible with a heat-resistance preserving property in a further improved manner.

Furthermore, the acid number of the rosin-based resin is preferably 40 mgKOH/g or less, more preferably 30 mgKOH/g or less, and still more preferably from 5 to 25 mgKOH/g or less. Accordingly, it is possible to make the fixing property of the toner particles compatible with the heat-resistance preserving property in a further improved manner.

Furthermore, the content ratio of the rosin-based resin in the resin material constituting the toner particles is preferably from 1 to 50 wt %, more preferably from 5 to 40 wt %. Accordingly, it is possible to make the fixing property of the toner particles compatible with the heat-resistance preserving property in a further improved manner.

The softening point of the resin material is not particularly limited, but preferably from 50 to 130° C., more preferably from 50 to 120° C., and still more preferably from 60 to 115° C. Moreover, in the present specification, the softening point indicates softening starting temperature defined with measuring conditions in which a rate of temperature increase is 5° C./min and a hole diameter of a die is 1.0 mm in a flow tester (Shimadzu Corporation).

2. Coloring Agent

Furthermore, the toner may include a coloring agent. The coloring agent is not particularly limited, but for example, known pigments, dye can be used.

3. Other Components

Furthermore, the toner may include components other than those mentioned above. Such components can be exemplified, for example, known wax, magnetic powder.

In addition to the materials described above, for example, zinc stearate, zinc oxide, cerium oxide, silica, titanium oxide, iron oxide, fatty acid, fatty acid metal salt may be used as a constituent material (component) of the toner particles.

Polyalkyleneimine

The toner particles constituted with the aforementioned materials preferably have the surface modified with polyalkyleneimine. In addition, the modification with the polyalkyleneimine refers that at least part of an amino group of the polyalkyleneimine undergoes a chemical reaction with at least part of an acid group (mainly a carboxyl group) derived from the resin material on the surface of the toner particles to form a covalent bond (amide bond), or that the acid group of the resin material and the amino group of the polyalkyleneimine form an ion bond.

The polyalkyleneimine is a compound having a high positive charging property because it has a large amount of amino groups. Since the polyalkyleneimine chemically adheres (bonds) to the surface of the toner particles, there are a large amount of amino groups having the positive charge charging property on the surface of the toner particles, and the positive charge charging property of the toner particles can be improved. In addition, since the polyalkyleneimine chemically adheres to the surface of the toner particles, it is hard for the polyalkyleneimine to leave the surface of the toner particles, and it is possible to make the positive charge charging property of the toner particles excellent over a long period of time and also possible to stably disperse the toner particles in the insulating liquid over a long period of time.

Furthermore, since the polyalkyleneimine has high affinity for the epoxy modified fatty acid alkyl ester, and the surface of the toner particles is modified with the polyalkyleneimine, it is possible to make the dispersion stability of the toner particle particularly excellent. In addition, the resin material modified with the polyalkyleneimine appropriately infiltrates into the recording medium together with the epoxy modified fatty acid alkyl ester, and thereby it is possible to improve the fixing strength of the toner particles.

As the polyalkyleneimine, for example, there are polyethyleneimine, polypropyleneimine, polybutyleneimine, polyisopropyleneimine. Among these, it is preferable to use polyethyleneimine. Accordingly, it is possible to further appropriately modify the surface of the toner particles, and to further improve the long-term dispersion stability, and the positive charge charging property of the toner particles.

The weight-average molecular weight of the polyalkyleneimine is preferably from 10,000 to 70,000. When the weight-average molecular weight of the polyalkyleneimine is within the above range, it is possible to modify (chemical modification) the surface of the toner particles more effectively, to prevent the clumping of the toner particles due to steric hindrance by a relatively long molecular chain of the polyalkyleneimine more effectively, and to improve the dispersion stability of the toner particles more effectively.

Shape of Toner Particles

An average particle diameter of the toner particles constituted with aforementioned materials is preferably from 0.5 to 5 μm, more preferably from 1 to 4 μm, and still more preferably from 1 to 3.5 μm. When the average particle diameter of the toner particles is a value within the above range, it is possible to reduce unevenness of characteristics among the toner particles, to enhance reliability for the entire liquid developer, and to sufficiently improve the resolution of a toner image formed by the liquid developer. In addition, it is possible to make the toner particles appropriately dispersed in the insulating liquid, and to improve the preserving property of the liquid developer. Furthermore, in the present specification, the "average particle diameter" indicates an average particle diameter based on volume.

The content ratio of the toner particles in the liquid developer is preferably from 10 to 60 wt %, and more preferably from 20 to 50 wt %.

Method of Producing Liquid Developer

Next, an exemplary embodiment of the method of producing the liquid developer according to the invention will be described.

The method of producing the liquid developer according to the present embodiment includes a resin solution preparing process for preparing a resin solution in which the resin materials constituting the above toner particles are dissolved in an organic solvent, an O/W emulsified liquid preparing process for preparing an O/W emulsified liquid after passing through a state of a W/O emulsified liquid by adding a water-based liquid to the prepared resin solution, a uniting process for uniting a dispersoid contained in the prepared O/W emulsified liquid to obtain united particles, an organic solvent removing process for removing an organic solvent contained in the united particles to form toner particles, a chemically modifying process for modifying the surface of the obtained toner particles with polyalkyleneimine, and a dispersion in an insulating liquid process for dispersing the toner particles in the insulating liquid.

Hereinafter, each process in the method of producing the liquid developer will be described in detail.

Resin Solution Preparing Process

First, a resin solution is prepared in which the resin materials and the like are dissolved in an organic solvent.

The prepared resin solution includes constituent materials of the toner particles as described above and the organic solvent to be described below.

As the organic solvent, any one in which at least some of the resin materials are dissolved may be used, but the one having a lower boiling point than the water-based liquid to be described later may be preferably used. Accordingly, it is possible to easily remove the organic solvent.

Furthermore, the organic solvent is preferably the one having low compatibility with the water-based liquid (water-based dispersion medium) to be described later (for example, the one having 30 g or less of solubility for 100 g of the water-based liquid at 25° C.). Accordingly, it is possible to finely disperse the dispersoid constituted with a parent particle material in the O/W emulsified liquid (water-based emulsified liquid) to be described later in a stable state.

Furthermore, the composition of the organic solvent can be appropriately selected, for example, according to the composition of the aforementioned resin materials, coloring agent, water-based liquid (water-based dispersion medium).

Such organic solvent is not particularly limited, and, for example, a ketone-based solvent such as MEK, an aromatic hydrocarbon-based solvent such as toluene, and the like can be exemplified.

The resin solution can be obtained by mixing, for example, the resin material, coloring agent, organic solvent together by a stirrer. As the stirrer which can be used for preparing the resin solution, a high speed stirrer can be exemplified, for example, DESPA (made by Asada Iron Works, Co., Ltd.), T.K. Robomix/T.K. Homo Disper 2.5 type blade (made by Primix Corporation).

Furthermore, the material temperature during the stirring is preferably from 20 to 60° C., and more preferably from 30 to 50° C.

The content ratio of the solid content in the resin solution is not particularly limited, but is preferably from 40 to 75 wt %, more preferably from 50 to 73 wt %, and still more preferably from 50 to 70 wt %. When the content ratio of the solid content is within the above range, it is possible to make the dispersoid constituting dispersion liquid (water-based dispersion liquid) to be described below have higher degree of sphericity (a shape close to an accurate sphere), and ensure shapes of the toner particles are more appropriate.

Furthermore, in the preparation of the resin solution, it is possible to mix constituent components of a resin solution to be prepared all together at the same time, and to mix some of the constituent components of the resin solution to be prepared to obtain a mixture (master) in advance, and then to mix other components with the mixture (master).

O/W Emulsified Liquid Preparing Process

Next, the O/W emulsified liquid is prepared by adding the water-based liquid in the resin solution and passing through the W/O emulsified liquid.

As the water-based liquid, any one mainly constituted with water can be used.

The water-based liquid may contain, for example, a solvent excellent in compatibility with water (for example, a solvent of which the degree of solubility with respect to water of 100 parts by weight at 25° C. is 50 or more parts by weight).

Furthermore, the water-based liquid may be added with emulsified dispersant depending on the necessity. With the addition of the emulsified dispersant, it is possible to more easily prepare water-based emulsified liquid. The emulsified dispersant is not particularly limited, but for example, it is possible to use known emulsified dispersant.

Furthermore, when the O/W emulsified liquid is prepared, for example, a basic substance may be used. Accordingly, for example, it is possible to neutralize a functional group in the resin material (for example, a carboxyl group), and to make the regularity in the shape and size of the dispersoid in the prepared O/W emulsified liquid and the dispersing property of the dispersoid particularly excellent. For this reason, the obtained toner particles have a particularly narrow distribution of the granularity. The basic substance, for example, may be added to the resin solution, and to the water-based liquid. Moreover, the basic substance may be added over plural times in the preparation of the O/W emulsified liquid.

As the basic substance, for example, sodium hydrate, potassium hydrate, ammonia can be exemplified, and one kind of a combination of two or more kinds among them can be used. In addition, the amount of the basic substance to be used is preferably an amount equivalent to one to three folds of the amount necessary for neutralizing all carboxyl groups in the resin material (1 to 3 equivalent amount), and more preferably an amount equivalent to one to two folds thereof (1 to 2 equivalent amount). Accordingly, it is possible to effectively prevent a hetero-dispersoid from being formed, and to make narrower distribution of granularity of the particles obtained in the uniting process to be described below.

The addition of the water-based liquid to the resin solution may be performed in any method, but it is preferable that the water-based liquid containing water is added to the resin solution while stirring the resin solution. In other words, it is preferable that the W/O type emulsified liquid (W/O emulsified liquid) is subjected to phase transfer to the O/W type emulsified liquid (O/W emulsified liquid) by gradually adding (dropping) the water-based liquid to the resin solution while shearing the resin solution with a stirrer or the like. Accordingly, it is possible to particularly improve the regularity of the size and shape of the dispersoid contained in the O/W emulsified liquid, to have very narrow distribution of the granularity of the toner particles contained in the finally obtained liquid developer, and to particularly reduce the unevenness in characteristics of the toner particles.

As the stirrer that can be used in the preparation of the O/W emulsified liquid, a high speed stirrer or a high speed disperser, for example, DESPA (made by Asada Iron Works, Co., Ltd.), T.K. Robomix/T.K. Homo Disper 2.5 type blade (made by Primix Corporation), Slusher (Mitsui Mining Company), Cavitron (Eurotech Co., Ltd.) may be exemplified.

Furthermore, the speed of the blade tip for stirring is preferably from 10 to 20 m/sec during the addition of the water-based liquid to the resin solution, and more preferably from 12 to 18 m/sec. When the speed of the blade tip is within the above range, it is possible to efficiently obtain the O/W emulsified liquid, to particularly reduce the unevenness in the shape and size of the dispersoid in the O/W emulsified liquid, and to particularly improve the uniformly dispersing property of the dispersoid while preventing the generation of excessively fine dispersoid and coarse particles.

The content ratio of the solid content in the O/W emulsified liquid is not particularly limited, but preferably from 5 to 55 wt %, more preferably from 10 to 50 wt %. Accordingly, it is possible to further assuredly prevent the unintended clumping of the dispersoids in the O/W emulsified liquid, and to particularly improve the productivity of the liquid developer.

Furthermore, the material temperature in the present process is preferably from 20 to 60° C., and more preferably from 20 to 50° C.

Uniting Process

Next, a plurality of dispersoids are united, and thereby united particles are obtained. The uniting of the dispersoids proceeds in an integrated state of the dispersoids by collision of the dispersoids containing organic solvents.

The uniting of the plurality of dispersoids is performed by adding electrolyte to the O/W emulsified liquid while stirring the O/W emulsified liquid. Accordingly, it is possible to easily and assuredly obtain the united particles. Moreover, it is possible to easily and assuredly control the distribution of the granularity and diameter of the united particles by adjusting the addition amount of the electrolyte.

The electrolyte is not particularly limited, but it is possible to use one kind or a combination of two or more kinds of organic or inorganic water-soluble salt.

Furthermore, the electrolyte is preferably a monovalent cation salt. Accordingly, it is possible to have a particularly narrow distribution of the granularity of the obtained united particles. In addition, by using the monovalent cation salt, it is possible to assuredly prevent the generation of coarse particles in the present process.

Furthermore, for the aforementioned electrolyte, sulfate (for example, sodium sulfate, or ammonium sulfate) or carbonate is preferable, and the sulfate is particularly preferable. Accordingly, it is possible to control the diameter of the united particles particularly easily.

The amount of the electrolyte added in the present process is preferably from 0.5 to 3 parts by weight and more preferably from 1 to 2 parts by weight for 100 parts by weight of the solid content contained in the O/W emulsified liquid to which the electrolyte is added. Accordingly, it is possible to control the diameter of the united particles particularly assuredly and easily, and to assuredly prevent the generation of coarse particles.

Furthermore, it is preferably to add the electrolyte in a water solution state. Accordingly, it is possible to swiftly diffuse the electrolyte in the entire O/W emulsified liquid, and to easily and assuredly control the addition amount of the electrolyte. As a result, it is possible to obtain the united particles having very narrow distribution of the granularity with a desired particle diameter.

Furthermore, when the electrolyte is added in a water solution state, the concentration of the electrolyte in the water solution is preferably from 2 to 10 wt %, and more preferably from 2.5 to 6 wt %. Accordingly, it is possible to particularly swiftly diffuse the electrolyte in the entire O/W emulsified liquid, and to easily and assuredly control the addition amount of the electrolyte. In addition, with the addition of the water solution as above, the content amount of water in the O/W emulsified liquid is preferable at the time when the addition of the electrolyte is finished. For this reason, the growth speed of the united particles after the addition of the electrolyte can be appropriately low so long as productivity does not decrease. As a result, it is possible to more assuredly control the particle diameter. Moreover, it is possible to assuredly prevent the unintended uniting of the united particles.

Furthermore, when the electrolyte is added in the water solution state, the speed of adding the electrolyte water solution is preferably from 0.5 to 10 parts by weight/min, and 1.5 to 5 parts by weight/min with respect to 100 parts by weight of the solid content contained in the O/W emulsified liquid to which the water solution is added. Accordingly, it is possible to prevent the occurrence of the unevenness of the electrolyte concentration in the O/W emulsified liquid, and to assuredly prevent the generation of the coarse particles. In addition, the distribution of the granularity of the united particles becomes narrower. Moreover, with the addition of the electrolyte at the above speed, it is possible to particularly easily control the speed of the uniting, to particularly easily control the average diameter of the united particles, and to particularly improve the productivity of the liquid developer.

The addition of the electrolyte may be performed over plural times. Accordingly, it is possible to easily and assuredly obtain the united particles with a desired size, and ensure the degree of circularity of the obtained united particles is sufficiently large.

Furthermore, the present process is performed in a state where the O/W emulsified liquid has been stirred. Accordingly, it is possible to obtain the united particles with particularly low unevenness in the shape and size of the particles.

In the stirring of the O/W emulsified liquid, a stirring blade, for example, an anchor blade, a turbine blade, a pfaudler blade, a fullzone blade, a maxblend blade, a halfmoon blade may be used, but among these, the maxblend blade and the fullzone blade are preferable. Accordingly, it is possible to assuredly prevent the occurrence of the unevenness in the electrolyte concentration by dispersing and dissolving the added electrolyte swiftly and uniformly. In addition, it is possible to more assuredly prevent the collapse of the united particles that have been formed while efficiently uniting the dispersoid. As a result, it is possible to efficiently obtain the united particles having the low unevenness in the shape and the diameter of the particles.

The speed of the blade tip of a stirrer is preferably from 0.1 to 10 m/sec, more preferably from 0.2 to 8 m/sec, and still more preferably from 0.2 to 6 m/sec. When the speed of the blade tip is within the above range, it is possible to assuredly prevent the occurrence of the unevenness in the electrolyte concentration by uniformly dispersing and dissolving the added electrolyte. In addition, it is possible to more assuredly prevent the collapse of the united particles that have been formed while efficiently uniting the dispersoid.

The average diameter of the obtained united particles is preferably from 0.5 to 5 μm, and more preferably from 1.5 to 3 μm. Accordingly, it is possible to more assuredly make the diameter of the finally obtained toner particles appropriate.

Organic Solvent Removing Process

Thereafter, the organic solvent included in the O/W emulsified liquid (particularly, in the dispersoid) is removed. Accordingly, a dispersion liquid in which the toner particles are dispersed in a water-based dispersion medium (water-based dispersion liquid) is obtained.

The removal of the organic solvent may be performed in any method, but for example, can be performed under reduced pressure. Accordingly, it is possible to efficiently remove the organic solvent while sufficiently preventing the modification of constituent materials such as a resin material.

Furthermore, the treatment temperature in the present process is preferably lower temperature than a glass-transition point (Tg) of the resin material constituting the united particles.

Furthermore, the present process may be performed in a state where a defoaming agent is added to the O/W emulsified liquid (dispersion liquid). Accordingly, it is possible to efficiently remove the organic solvent.

As the defoaming agent, for example, a mineral oil-based defoaming agent, a polyether-based defoaming agent, a silicone-based defoaming agent, lower alcohols, higher alcohols, fats, fatty acids, fatty acid esters, phosphoric esters may be used.

The amount of the defoaming agent to be used is not particularly limited, but preferably from 20 to 300 ppm, and more preferably from 30 to 100 ppm in ratio by weight with respect to the solid content contained in the O/W emulsified liquid.

Furthermore, in the present process, at least some of the water-based solution may be removed as well as the organic solvent.

In addition, in the present process, it may not completely remove the entire organic solvent (the total amount of the organic solvent contained in the dispersion liquid). Even in such a case, it is possible to remove the remaining organic solvent in the process to be described below.

Cleaning Process (First Cleaning Process)

Next, cleaning of the toner particles obtained as above is performed. Accordingly, it is possible to obtain a dispersion liquid containing the cleaned toner particles (water-based dispersion liquid).

With the execution of the present process, even when the organic solvent or the like is contained as impurities, the organic solvent can be efficiently removed. In addition, with the execution of the present process, it is possible to remove salt generated by the electrolyte, basic substance, acid substance, or acid-base reaction used in the above processes. As a result, it is possible to particularly reduce the amount of a total volatile organic compound (TVOC) in the finally obtained toner particles. Moreover, it is possible to particularly increase the electric resistance of the insulating liquid and to improve the stability of characteristics that the toner particles have.

The present process can be performed by separating the toner particles by solid-liquid separation (separated from the water-based liquid), and then by dispersing the solid content (toner particles) again in the water-based liquid (water-based dispersion medium). The solid-liquid separation and the re-dispersion of the solid content in water may be repeated plural times. Moreover, it is preferable that the cleaning is performed until the conductivity of a supernatant solution of the dispersion liquid in which the solid content (toner particles) are re-dispersed (slurry) in the water-based liquid (water-based dispersion medium) is 20 μS/cm or less.

Surface Modifying Process

Next, the dispersion liquid containing the aforementioned toner particles (water-based dispersion liquid) and the polyalkyleneimine are mixed together and the surface of the aforementioned toner particles is modified with the polyalkyleneimine.

The present process may be performed by mixing the water-based dispersion liquid and the polyalkyleneimine, but preferably performed in a state where the hydrogen-ion exponent (pH) of the dispersion liquid (water-based dispersion liquid) is adjusted to be 2 to 8. Accordingly, it is possible to more efficiently carry out the reaction of the polyalkyleneimine and the acid group existing on the surface of the toner particles constituted with a material containing a rosin-based resin, and to more strongly bond the polyalkyleneimine to the surface of the toner particles, while assuredly preventing unintended modification of a constituent material in the toner particles or the like. As a result, it is possible to particularly improve the long-term dispersion stability and stability of a charging property of the toner particles. As described above, the hydrogen-ion exponent (pH) of the dispersion liquid (water-based dispersion liquid) in the present process is preferably from 2 to 8, more preferably from 2.5 to 6.5, and still more preferably from 4 to 5. Accordingly, the above-mentioned effects are more remarkably exhibited.

The pH adjustment of the dispersion liquid described above can be performed by adding, for example, 1N hydrochloric acid.

Furthermore, after the mixing of the dispersion liquid and the polyalkyleneimine, it is preferable that the mixed liquid is stirred for about 1 to 3 hour(s). Accordingly, the surface of the toner particles can be more uniformly modified (chemically modified).

Furthermore, the stirring may be performed at normal temperature, and may be performed by heating the mixed liquid to about 30 to 40° C. With the stirring by heating, the surface of the toner particles can be more efficiently modified (chemically modified).

Cleaning Process (Second Cleaning Process)

Next, the toner particles obtained as described above are cleaned.

With the execution of the present process, even when the organic solvent or the like is contained as impurities, the organic solvent can be efficiently removed. As a result, it is possible to particularly reduce the amount of a total volatile organic compound (TVOC) in the finally obtained toner particles. In addition, the stability of the characteristics of the toner particles is improved.

Moreover, the polyalkyleneimine strongly bonds to the toner particles containing the rosin-based resin as described above. For this reason, the polyalkyleneimine is different from the dispersing agent used in the liquid developer in the past, and can be prevented from separation or drop-off from the toner particles even after being subjected to the cleaning process.

The present process separates the toner particles by, for example, the solid-liquid separation (separation from the water-based liquid), and after that, can be performed by re-dispersion of the solid content (toner particles) to the water-based liquid (water-based dispersion medium) and the solid-liquid separation (separation of the toner particles from the water-based liquid). The re-dispersion of the solid content in water and the solid-liquid separate may be repeated plural times.

Drying Process

Thereafter, by performing the drying process, the toner particles of which the surface is modified with the ployalkyleneimin can be obtained. With such a process, it is possible to assuredly lower the water amount in the toner particles, and to particularly improve the preserving property, and stability in characters of the finally obtained liquid developer.

As the drying process, for example, a vacuum dryer (for example, Ribocone (made by Okawara Corporation), Nauta (made by Hosokawa Micron Corporation)), a fluid bed dryer (made by Okawara Corporation) can be used.

Dispersion in an Insulating Liquid Process

Next, the toner particles obtained as above are dispersed in the insulating liquid. Accordingly, the liquid developer is obtained.

The dispersion of the toner particles in the insulating liquid may use any method, and for example, the insulating liquid and the toner particles may be mixed with a beads mill, a ball mill, or the like.

Furthermore, during the dispersion, components other than the insulating liquid and the toner particles may be mixed.

Furthermore, the dispersion of the toner particles in the insulating liquid may be performed by using total amount of the insulating liquid constituting the finally obtained liquid developer, or by using some of the insulating liquid.

Furthermore, when the toner particles are dispersed by using some of the insulating liquid, a same liquid as the liquid used in the dispersion may be added as an insulating liquid after the dispersion, or a difference liquid from the liquid used in the dispersion may be added as an insulating liquid after the dispersion. In the latter case, it is possible to easily adjust characteristics such as viscosity of the finally obtained liquid developer.

When the liquid developer is prepared by the method as described above, the unevenness in the shape and characteristics of the toner particles are reduced. As a result, the unevenness in the amount of the insulating liquid adhering to the surface of the toner particles is reduced, the unevenness in the fixing strength is reduced, and thereby the fixing property is excellent. In addition, the dispersion stability of the toner particles can be further improved.

Image Forming Method

Next, an exemplary embodiment of the image forming method according to the invention will be described.

First, an exemplary embodiment of an image forming apparatus to which the image forming method of the invention is applied will be described.

Figure 2:
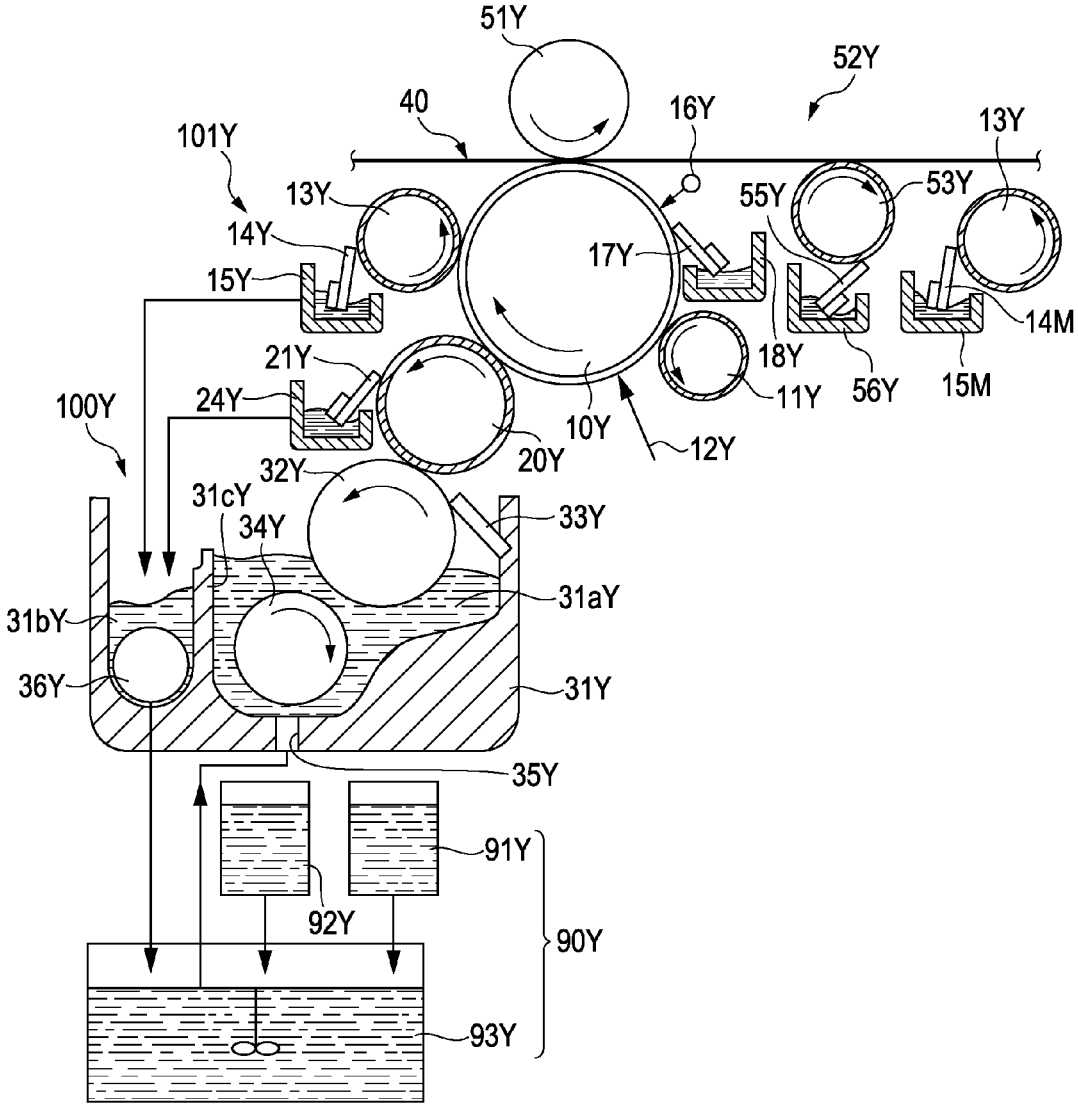
FIG. 2 is an enlarged diagram illustrating an enlarged part of the image forming apparatus shown in FIG. 1.

FIG. 1 is a diagram schematically illustrating an exemplary embodiment of the image forming apparatus to which the liquid developer of the invention is applied, and FIG. 2 is an enlarged diagram illustrating an enlarged part of the image forming apparatus shown in FIG. 1.

An image forming apparatus 1000 is provided 4 developing sections 30Y, 30M, 30C, and 30K, an intermediate transfer section 40, a secondary transfer unit (secondary transfer section) 60, a fixing section (fixing device) F40, and 4 liquid developer supplying sections 90Y, 90M, 90C, and 90K, as shown in FIGS. 1 and 2.

The developing sections 30Y, 30M, and 30C each develop a latent image with a yellow-based liquid developer (Y), a magenta-based liquid developer (M), a cyan-based liquid developer (C), and have a function of forming a monochromatic image corresponding to each color. In addition, the developing section 30K develops a latent image with a black-based liquid developer (K), and has a function of forming a monochromatic image of black.

Since the structure of the developing sections 30Y, 30M, 30C, and 30K are the same, only the developing section 30Y will be described below.

The developing section 30Y is provided with a photoreceptor 10Y as an example of an image carrier, a charge roller 11Y, an exposure unit 12Y, a developing unit 100Y, a photoreceptor squeeze device 101Y, a first transfer backup roller 51Y, a neutralizing unit 16Y, a photoreceptor cleaning blade 17Y, and a developer collecting section 18Y along the rotation direction of the photoreceptor 10Y, as shown in FIG. 2.

The photoreceptor 10Y has an outer circumferential face formed of a cylindrical base material and a photosensitive layer formed of, for example, amorphous silicon, and is rotatable around the center axis. In this embodiment, the photoreceptor 10Y rotates clockwise as shown by the arrow in FIG. 2.

The photoreceptor 10Y is supplied with a liquid developer by the developing unit 100Y to be described later, and the surface thereof is formed with a liquid developer layer.

The charge roller 11Y is a device for charging the photoreceptor 10Y, and the exposure unit 12Y is a device for forming a latent image on the photoreceptor 10Y charged by the irradiation of laser. The exposure unit 12Y is provided with a semiconductor laser, a polygon mirror, an F-θlens, and the like, and irradiates the charged photoreceptor 10Y with modulated laser based on an image signal input from a host computer (not shown) such as a personal computer, a word processor.

The developing unit 100Y is a device for developing a latent image formed on the photoreceptor 10Y by using the liquid developer of the invention. Details of the developing unit 100Y will be described later.

The photoreceptor squeeze device 101Y is provided facing with the photoreceptor 10Y in the downstream side of the developing unit 100Y in the rotation direction, and constituted with a photoreceptor squeeze roller 13Y, a cleaning blade 14Y for removing a liquid developer adhering to the surface of the photoreceptor squeeze roller 13Y which comes into contact with and slides across thereof in a pressing manner, and a developer collecting section 15Y for collecting the removed liquid developer. The photoreceptor squeeze device 101Y has functions of collecting fogging toner, which is initially unnecessary, and surplus carriers (insulating liquid) from the developer used in development in the photoreceptor 10Y, and of raising the ratio of the toner particles in a developed image.

The first transfer backup roller 51Y is a device for transferring a monochromic image formed on the photoreceptor 10Y to the intermediate transfer section 40 to be described later.

The neutralizing unit 16Y removes remaining charges on the photoreceptor 10Y after an image subjected to an intermediate-transfer is transferred on the intermediate transfer section 40 by the first transfer backup roller 51Y.

The photoreceptor cleaning blade 17Y is made of a rubber member coming into contact with the surface of the photoreceptor 10Y, and has a function of scraping out and removing the liquid developer remaining on the photoreceptor 10Y, after an image is transferred on the intermediate transfer section 40 by the first transfer backup roller 51Y.

The developer collecting section 18Y has a function of collecting the liquid developer removed by the photoreceptor cleaning blade 17Y.

The intermediate transfer section 40 is an endless elastic belt member, and is stretched between a belt driving roller 41 to which the driving force of a motor (not shown) is transmitted, and a pair of driven rollers 44 and 45 with tension. In addition, the intermediate transfer section 40 is rotatably driven counterclockwise by the belt driving roller 41 while coming into contact with the photoreceptors 10Y, 10M, 10C, and 10K, with the first transfer backup rollers 51Y, 51M, 51C, and 51K.

Furthermore, the intermediate transfer section 40 is applied with a predetermined tension by a tension roller 49 to eliminate sagging. The tension roller 49 is provided in the downstream side of one driven roller 44 in the rotation (move) direction of the intermediate transfer section 40 and the upstream side of the other driven roller 45 in the rotation (move) direction of the intermediate transfer section 40.

Monochromatic images corresponding to each color formed in the developing sections 30Y, 30M, 30C, and 30K is sequentially transferred to the intermediate transfer section 40 by the first transfer backup rollers 51Y, 51M, 51C, and 51K, and the monochromic images corresponding to each color overlap. Thereby, Full-color developer images (intermediate-transferred image) are formed in the intermediate transfer section 40.

The monochromic images formed in the plurality of photoreceptors 10Y, 10M, 10C, and 10K as above are sequentially secondary-transferred, overlapped, and carried in the intermediate transfer section 40, and are collectively secondary-transferred to a recording medium F5 such as paper, film, fabric in the secondary transfer unit 60 to be described later. For this reason, in transferring a toner image to the recording medium F5 in the secondary transferring process, even if the surface of the recording medium F5 is a sheet material that is not flat or smooth due to fibers, an elastic belt member may be employed as a medium to improve a secondary transfer property according to the surface of the sheet material that is not flat or smooth.

Furthermore, the intermediate transfer section 40 is provided with a cleaning device including an intermediate transfer section cleaning blade 46, a developer collecting section 47, and a non-contact-type bias applying member 48.

The intermediate transfer section cleaning blade 46 and the developer collecting section 47 are provided in the driven roller 45 side.

The intermediate transfer section cleaning blade 46 has a function of scraping the liquid developer adhering on the intermediate transfer section 40 for removal after an image is transferred to the recording medium F5 by the secondary transfer unit (secondary transfer section) 60.

The developer collecting section 47 has a function of collecting the liquid developer removed by the intermediate transfer section cleaning blade 46.

The non-contact-type bias applying member 48 is provided in a position facing with the tension roller 49 and is separated from the intermediate transfer section 40. The non-contact-type bias applying member 48 applies a bias voltage with a polarity opposite to that of the toner to the toner (solid content) in the liquid developer remaining on the intermediate transfer section 40 after the secondary transfer. Accordingly, the toner is neutralized, and thereby the electrostatic adhering force of the toner to the intermediate transfer section 40 is reduced. In this example, a corona charger may be used as the non-contact-type bias applying member 48.

Furthermore, it is not necessary to provide the non-contact-type bias applying member 48 in a position facing the tension roller 49, but can be provided in a downstream side of the driven roller 44 in the moving direction of the intermediate transfer section such as a position between the driven roller 44 and the tension roller 49, and an arbitrary position in the upstream side of the driven roller 45 in the moving direction of the intermediate transfer section. In addition, as the non-contact-type bias applying member 48, known non-contact-type chargers other than the corona charger may be used.

Furthermore, an intermediate transfer section squeeze device 52Y is provided in the downstream side of the first transfer backup roller 51Y in the moving direction of the intermediate transfer section 40.

When the liquid developer transferred onto the intermediate transfer section 40 has not been in a state of desired dispersion, the intermediate transfer section squeeze device 52Y is provided as a device for removing the surplus insulating liquid from the transferred liquid developer.

The intermediate transfer section squeeze device 52Y is constituted with an intermediate transfer section squeeze roller 53Y, an intermediate transfer section squeeze cleaning blade 55Y for cleaning the surface of the intermediate transfer section squeeze roller 53Y coming into contract with and sliding across thereof in a pressing manner, and a developer collecting section 56Y for collecting the liquid developer removed by the intermediate transfer section squeeze cleaning blade 55Y.

The intermediate transfer section squeeze device 52Y has functions of collecting the surplus insulating liquid from the liquid developer first-transferred onto the intermediate transfer section 40, raising the ratio of the toner particles in an image, and collecting fogging toner which is initially unnecessary.

The secondary transfer unit 60 is provided with a pair of the secondary transfer rollers which are set apart from each other at a predetermined interval along the transferring material moving direction. In the pair of the secondary transfer rollers, the secondary transfer roller provided in the upstream side of the moving direction of the intermediate transfer section 40 is an upstream-side secondary transfer roller 64. The upstream-side secondary transfer roller 64 comes into press contact with the belt driving roller 41 via the intermediate transfer section 40.

Furthermore, in the pair of the secondary transfer rollers, the secondary transfer roller provided in the downstream side of the moving direction of the transferring material is a downstream-side secondary transfer roller 65. The downstream-side secondary transfer roller 65 comes into press contact with the driven roller 44 via the intermediate transfer section 40.

In other words, the upstream-side secondary transfer roller 64 and the downstream-side secondary transfer roller 65 each make the intermediate transfer section 40 suspended around the belt driving roller 41 and the driven roller 44 to come into contact with the recording medium F5, an intermediate-transfer image formed on the intermediate transfer section 40 by superimposing colors is secondary-transferred to the recording medium F5.

In this case, the belt driving roller 41 and the driven roller 44 each function as backup rollers of the upstream-side secondary transfer roller 64 and the downstream-side secondary transfer roller 65. In other words, the belt driving roller 41 is also used as an upstream-side backup roller provided in the upstream side of the driven roller 44 in the moving direction of the recording medium F5 in the secondary transfer unit 60. In addition, the driven roller 44 is also used as a downstream-side backup roller provided in the downstream side of the belt driving roller 41 in the moving direction of the recording medium F5 in the secondary transfer unit 60.

Therefore, the recording medium F5 fed to the secondary transfer unit 60 closely contacts the intermediate transfer section 40 in a predetermined moving region of the transferring material from a press-contact starting position of the upstream-side secondary transfer roller 64 and the belt driving roller 41 (a nip starting position) to a press-contact ending position of the downstream-side secondary transfer roller 65 and the driven roller 44 (a nip ending position). Accordingly, since the intermediate-transfer image of full colors on the intermediate transfer section 40 is second-transferred to the recording medium F5 in a state of closely contacting the intermediate transfer section 40 over a predetermined time, favorable secondary transfer is achieved.

Furthermore, the secondary transfer unit 60 is provided with a secondary transfer roller cleaning blade 66, and a developer collecting section 67 for the upstream-side secondary transfer roller 64. In addition, the secondary transfer unit 60 is provided with a secondary transfer roller cleaning blade 68, and a developer collecting section 69 for the downstream-side secondary transfer roller 65. The secondary transfer roller cleaning blades 66 and 68 each come into contact with the secondary transfer rollers 64 and 65 and scrapes and removes the liquid developer remaining on the surface of each of the secondary transfer rollers 64 and 65 after the secondary-transfer. Moreover, the developer collecting sections 67 and 69 collect and retain the liquid developer scraped from the secondary transfer rollers 64 and 65 by each of the secondary transfer roller cleaning blades 66 and 68.

A toner image (transferred image) F5*a* transferred onto the recording medium F5 by the secondary transfer section 60 is sent to the fixing section (fixing device) F40, applied with heat and pressure to be fixed on the recording medium F5.

Furthermore, the fixing temperature (setting temperature) is preferably from 80 to 160° C., more preferably from 100 to 150° C., and even more preferably from 100 to 140° C. in particular.

Next, the developing units 100Y, 100M, 100C, and 100K will be described in detail. In addition in the following description, the developing unit 100Y will be described as a representative example.

As shown in FIG. 2, the developing unit 100Y includes a liquid developer retaining section 31Y, a coating roller 32Y, a regulating blade 33Y, a developer stirring roller 34Y, a communicating section 35Y, a collection screw 36Y, a developing roller 20Y, and a developing roller cleaning blade 21Y.

The liquid developer retaining section 31Y has a function of retaining the liquid developer for developing a latent image formed on the photoreceptor 10Y, and is provided with a supplying section 31*a*Y for supplying the liquid developer to the developing section, a collecting section 31*b*Y for collecting the surplus liquid developer generated in the supplying section 31*a*Y or the like, and a partition 31*c*Y for partitioning the supplying section 31*a*Y and the collecting section 31*b*Y.

The supplying section 31*a*Y has a function of supplying the liquid developer to the coating roller 32Y and has a recessed portion where the developer stirring roller 34Y is provided. In addition, the liquid developer is supplied to the supplying section 31*a*Y from a liquid developer mixing tub 93Y through the communicating section 35Y.

The collecting section 31*b*Y collects the liquid developer excessively supplied to the supplying section 31*a*Y and the surplus liquid developer generated in the developer collecting sections 15Y and 24Y. The collected liquid developer is fed to the liquid developer mixing tub 93Y to be described later and reused. In addition, the collecting section 31*b*Y has a recessed portion where the collection screw 36Y is installed close to the bottom thereof.

The partition 31*c*Y of a wall shape is provided in the boundary of the supplying section 31*a*Y and the collecting section 31*b*Y. The partition 31*c*Y partitions the supplying section 31*a*Y and the collecting section 31*b*Y, and can prevent the collected liquid developer from being incorporated to fresh liquid developer. In addition, when the surplus liquid developer is supplied to the supplying section 31*a*Y, the surplus liquid developer may overflow from the supplying section 31*a*Y over the partition 31*c*Y to the collecting section 31*b*Y. For this reason, it is possible to constantly hold the amount of the liquid developer in the supplying section 31*a*Y and to constantly maintain the amount of the liquid developer supplied to the coating roller 32Y. For this reason, the quality of the finally formed image is stable.

Furthermore, the partition 31*c*Y is provided with a notched section, and the liquid developer can overflow from the supplying section 31*a*Y to the collecting section 31*b*Y through the notched section.

The coating roller 32Y has a function of supplying the liquid developer to the developing roller 20Y.

The coating roller 32Y is a so-called anilox roller, which is formed with grooves on the surface of the roller made of metal such as iron uniformly and in a spiral shape and subjected to a nickel plating, and has a diameter of 25 mm. In the present embodiment, a plurality of grooves is obliquely formed with respect to the rotation direction of the coating roller 32Y by a so-called cutting processing, a rolling processing, or the like. The grooves of the coating roller 32Y carry the liquid developer in the supplying section 31*a*Y by coming into contact with the liquid developer while rotating counterclockwise to feed the carried liquid developer to the developing roller 20Y.

The regulating blade 33Y regulates the amount of the liquid developer on the coating roller 32Y coming into contact with the surface of the coating roller 32Y. In other words, the regulating blade 33Y scrapes the surplus liquid developer on the coating roller 32Y and plays a role of measuring the amount of the liquid developer on the coating roller 32Y to be supplied to the developing roller 20Y. The regulating blade 33Y is made of urethane rubber as an elastic member and supported by a regulating blade supporting member made of a metal such as iron. In addition, the regulating blade 33Y is provided in a side where the coating roller 32Y rotates and advances from the liquid developer (in other words, in the right side of FIG. 2). Moreover, the hardness of the rubber of the regulating blade 33Y is about 77 degrees with JIS-A, and the hardness (about 77 degrees) of the contacting section of the regulating blade 33Y with the coating roller 32Y is lower than the hardness (about 85 degrees) of press-contacting section of an elastic body layer of the developing roller 20Y to be described later with the surface of the coating roller 32Y. In addition, the scraped surplus liquid developer is collected in the supplying section 31*a*Y and reused.

The developer stirring roller 34Y has a function of stirring the liquid developer in a uniformly dispersed state. Accordingly, even when the plurality of toner particles clumps together, the toner particles can be appropriately dispersed.

In the supplying section 31*a*Y, the toner particles in the liquid developer have plus charges, and the liquid developer is stirred by the developer stirring roller 34Y to be in a uniformly dispersed state, and drawn up from the liquid developer retaining section 31Y by the rotation of the coating roller 32Y. The regulating blade 33Y regulates the amount of the liquid developer to supply to the developing roller 20Y. In addition, by stirring the liquid developer by the developer stirring roller 34Y, it is possible to stably overflow the liquid developer to the collecting section 31*b*Y side over the partition 31*c*Y and to prevent the liquid developer from being retained and condensed.

Furthermore, the developer stirring roller 34Y is provided around the communicating section 35Y. For this reason, the liquid developer supplied from the communicating section 35Y can be swiftly dispersed, and even when the liquid developer is replenished to the supplying section 31*a*Y, the liquid level of the supplying section 31*a*Y can be stable. By providing the developer stirring roller 34Y around the communicating section 35Y, the communicating section 35Y becomes negative in pressure, and thereby the liquid developer can be spontaneously sucked up.

The communicating section 35Y is provided downwardly perpendicular to the developer stirring roller 34Y, communicates with the liquid developer retaining section 31Y, and is a part that sucks up the liquid developer from the liquid developer mixing tub 93Y to the supplying section 31*a*Y.

By providing the communicating section 35Y below the developer stirring roller 34Y, the liquid developer supplied from the communicating section 35Y is stopped by the developer stirring roller 34Y, and the liquid level can be constantly held without elevation of the liquid level due to blowing, and the developer can be stably supplied to the coating roller 32Y.

Furthermore, the collection screw 36Y provided around the bottom of the collecting section 31*b*Y is made of a cylindrical member, has ribs of a spiral shape in the outer circumference, and has functions of keeping the fluidity of the collected liquid developer and of promoting feeding of the liquid developer to the liquid developer mixing tub 93Y.

The developing roller 20Y carries the liquid developer and feeds the liquid developer to a developing position facing the photoreceptor 10Y in order to develop a latent image carried to the photoreceptor 10Y with the liquid developer.

The developing roller 20Y is formed with a liquid developer layer on the surface by supplying the liquid developer from the coating roller 32Y described above.

The developing roller 20Y is provided with an elastic body layer having conductivity in the outer circumference of the inner core made of metal such as iron, and has a diameter of about 20 mm. In addition, the elastic body layer is formed in a two-tier structure, and the inner layer is formed of urethane rubber having the hardness of the rubber of about 30 degrees in JIS-A, and the thickness of about 5 mm, and the surface layer (outer layer) is formed of urethane rubber having the hardness of the rubber of about 85 degrees in JIS-A and the thickness of about 30 μm. Moreover, the developing roller 20Y has the surface as a press-contacting section which comes into press contact with the coating roller 32Y and the photoreceptor 10Y in an elastically deformed state.

Furthermore, the developing roller 20Y is rotatable around the center axis, and the center axis is provided below the rotation center axis of the photoreceptor 10Y. In addition, the developing roller 20Y rotates in a direction opposite to the rotation direction (the clockwise direction in FIG. 2) of the photoreceptor 10Y (the counterclockwise direction in FIG. 2). In addition, when the latent image formed on the photoreceptor 10Y is developed, an electric field is formed between the developing roller 20Y and the photoreceptor 10Y.

Furthermore, in the developing unit 100Y, the coating roller 32Y and the developing roller 20Y are separately driven by different power sources (not shown). Therefore, by varying the proportion of the rotation speed (linear speed) of the coating roller 32Y and that of the developing roller 20Y, the amount of the liquid developer supplied onto the developing roller 20Y can be adjusted.

Furthermore, the developing unit 100Y is provided with the developing roller cleaning blade 21Y made of rubber and coming into contact with the surface of the developing roller 20Y and the developer collecting section 24Y. The developing roller cleaning blade 21Y is a device for scraping and removing the liquid developer remaining on the developing roller 20Y after the development is performed in the developing position. The liquid developer removed by the developing roller cleaning blade 21Y is collected into the developer collecting section 24Y.

Furthermore, as shown in FIGS. 1 and 2, the image forming apparatus 1000 is provided with liquid developer replenishing sections 90Y, 90M, 90C, and 90K for replenishing the liquid developer to the developing sections 30Y, 30M, 30C, and 30K. Each of the liquid developer replenishing sections 90Y, 90M, 90C, and 90K is provided with liquid developer tanks 91Y, 91M, 91C, and 91K, insulating liquid tanks 92Y, 92M, 92C, and 92K, and liquid developer mixing tubs 93Y, 93M, 93C, and 93K.

Each of the liquid developer tanks 91Y, 91M, 91C, and 91K houses the high-concentration liquid developers corresponding to each of the colors. Furthermore, each of the insulating liquid tanks 92Y, 92M, 92C, and 92K houses the insulating liquids. Moreover, each of the liquid developer mixing tubs 93Y, 93M, 93C, and 93K is configured such that predetermined amounts of the high-concentration liquid developers are supplied from each of the liquid developer tanks 91Y, 91M, 91C, and 91K thereto, and predetermined amounts of insulating liquids are supplied from each of insulating liquid tanks 92Y, 92M, 92C, and 92K thereto.

Furthermore, each of the liquid developer mixing tubs 93Y, 93M, 93C, and 93K prepares the liquid developers corresponding to each of the colors to be used in each of the supplying sections 31*a*Y, 31*a*M, 31*a*C, and 31*a*K by stirring to mix the high-concentration liquid developers and the insulating liquids supplied to the liquid developer mixing tubs by stirring devices equipped thereto. The liquid developers prepared in each of the liquid developer mixing tubs 93Y, 93M, 93C, and 93K are supplied to each of the supplying sections 31*a*Y, 31*a*M, 31*a*C, and 31*a*K.

In addition, the liquid developer collected by the collecting section 31*b*Y is collected to be reused in the liquid developer mixing tub 93Y. The same is applied to the liquid developer mixing tubs 93M, 93C, and 93K.

Furthermore, the image formation using the above apparatus is performed with a developing process for forming a plurality of monochromatic images corresponding to each of the colors on the photoreceptor 10 (10Y, 10M, 10C, and 10K) by using a plurality of liquid developers having different colors (the liquid developer of the invention), a transferring process for transferring the plurality of monochromatic images formed on the photoreceptor 10 to the recording medium F5 to form the unfixed toner image F5*a* by superimposing the plurality of monochromatic images on the recording medium F5, and a fixing process for fixing the unfixed toner image F5*a* onto the recording medium F5. By using such a method, an image having excellent color development can be easily formed.

Hereinabove, the present invention has been described based on the exemplary embodiment, but is not limited thereto.

For example, the liquid developer of the invention is not limited to the application to the image forming apparatus as described above.

Furthermore, the liquid developer of the invention is not limited to the production of the producing method as described above.

Furthermore, the aforementioned embodiment described that the united particles are obtained by having the water-based emulsified liquid and adding an electrolyte thereto, but the invention is not limited thereto. For example, the united particles are prepared such that a water-based emulsified liquid may be prepared by dispersing a coloring agent, a monomer, a surfactant, and a polymerization initiator in a water-based liquid for an emulsion polymerization and using an emulsion polymerization aggregation method where an electrolyte is added to the water-based emulsified liquid for aggregation, and by spray-drying the obtained water-based emulsified liquid.

Example

1. Preparation of Liquid Developer

A liquid developer was prepared as described below. The temperature is set to room temperature (25° C.) in a process where temperature is not specified.

Example 1

Dispersion Liquid Preparing Process

Water-Based Dispersion Liquid Preparing Process

Preparation of a Coloring Agent Master Solution

First, as a resin material, 60 parts by weight of polyester resin (10 mgKOH/g of an acid value, 55° C. of the glass transition point (Tg), and 107° C. of the softening point) was prepared.

Next, a mixture (50:50 of the mass ratio) of the resin material and a cyan-based pigment as a coloring agent (produced by Dainichiseika Color & Chemicals Mfg. Co., Ltd., 15:3 of pigment blue) was prepared. Each of the components are mixed together with 20 L henschel mixer to obtain a raw material for preparing toner.

Next, the raw material (mixture) was kneaded by using a biaxial kneading extruder. The kneaded material extruded from the extruding hole of the biaxial kneading extruder was cooled.

The kneaded material cooled as above was coarsely grounded to make a master batch as a coloring agent having an average diameter of 1.0 mm or less. A hammer mill was used for the coarse-grinding of the kneaded material.

Resin Solution Preparing Process 97.5 parts by weight of the master batch of the coloring agent is mixed with 175 parts by weight of methyl ethyl ketone, 172.3 parts by weight of the polyester resin, 55.3 parts by weight of rosin modified maleic resin (produced by Arakawa Chemical Industries, Ltd., the trade name of "Malkyd No. 1", the acid value of 25 mgKOH/g or less, the softening point of from 120 to 130, and the weight-average molecular weight of 3100) by a high-speed disperser (made by Primix Corporation, T.K. Robomix/T.K. Homo Disper 2.5 type blade), to prepare a resin solution by adding 1.38 parts by weight of Neogen SC-F (Daiichi Kogyo Seiyaku Co., Ltd.) thereto as an emulsifying agent.

O/W Emulsified Liquid Preparing Process

Next, 72.8 parts by weight of 1 regular ammonia water was added to the resin solution in a vessel, sufficiently stirred by a high-speed disperser (made by Primix Corporation, T.K. Robomix/T.K. Homo Disper 2.5 type blade) at 7.5 m/sec of the blade tip speed of the stirring blade. The temperature of the solution in the flask was adjusted to 25° C., and then the solution was stirred at 14.7 m/sec of the blade tip speed of the stirring blade. 400 parts by weight of deionized water was dropped thereto, and an O/W emulsified liquid where a dispersoid containing the resin material was dispersed via a W/O emulsified liquid by adding 100 parts by weight of the deionized water while continuing to stir.

Uniting Process

Next, the W/O emulsified liquid is moved to a stirring vessel having max blend blades and the temperature of the W/O emulsified liquid was set to 25° C. while stirring with a blade tip speed of the stirring blade of 1.0 m/sec. Then, while the same temperature and the same stirring condition were maintained, 200 parts by weight of 5.0% aqueous sodium sulfate solution was dropped thereto, the dispersoid was united, and the united particles were formed. After dropping, the mixture was continuously stirred until the 50% volume particle diameter Dv (50) [μm] for the united particles grew to be 2.5 μm. When the Dv (50) of the united particles was 2.5 μm, 200 parts by weight of the deionized water was added thereto and the uniting was ended.

Organic Solvent Removing Process

Next, the W/O emulsified liquid containing the united particles was put under reduced pressure, and the organic solvent was distilled until the content amount of the solid content becomes 23 wt % and a slurry (dispersion liquid) of the toner particles was obtained.

Cleaning Process (First Cleaning Process)

Next, solid-liquid separation was performed for the slurry (dispersion liquid), and the cleaning was performed by repeating the re-dispersion in water (re-slurry) and the solid-liquid separation. Furthermore, the cleaning was performed until the conductivity of the supernatant liquid on the slurry becomes 20 μS/cm or less.

Then, a wet cake of the toner particles (toner particles cake) was obtained by using the suction filtration method, and the wet cake was dispersed in water to obtain the dispersion liquid containing the cleaned toner particles (water-based dispersion liquid).

Surface Modifying Process

Next, 1N hydrochloric acid was added to the dispersion liquid containing the cleaned toner particles (water-based dispersion liquid) and the hydrogen-ion exponent (pH) was adjusted to be 4.0.

Then, the dispersion liquid (water-based dispersion liquid) of which the hydrogen-ion exponent (pH) was adjusted to be 4.0 and was stirred while dropping polyethyleneimine (weight-average molecular weight: 70000). At this point, the polyethyleneimine was added to be 1.0 part by weight with respect to 100 parts by weight of rosin-based resin. Then, the mixture was sufficiently stirred to make the entire dispersion liquid have a satisfactorily uniform composition.

Cleaning Process (Second Cleaning Process)

Next, the solid-liquid separation was performed for the dispersion liquid where the toner particles of which surface was modified with the polyethyleneimine was dispersed, and the cleaning was performed by repeating the re-dispersion in water (re-slurry), and the solid-liquid separation. Then, a wet cake of the toner particles (toner particles cake) was obtained by using the suction filtration method. Thus obtained wet cake had moisture content of 35 wt %. Furthermore, the liquid phase and filtrate separated by the solid-liquid separation were examined, but polyethyleneimine was not found.

Drying Process

Then, the obtained wet cake was dried by using a vacuum drier to obtain toner particles of which the surface was modified with the polyethyleneimine (chemical modification).

Dispersion in Insulating Liquid Process 50 parts by weight of the toner particles obtained in the above method, 120 parts by weight of canola oil (made by Nisshin Oillio Group Ltd., the trade name of "High-oleic Canola Oil") as an insulating liquid, and 80 parts by weight of epoxidized canola oil fatty acid 2-ethylhexyl (made by Adeka Corporation, the trade name of "Adekacizer D-32", the oxirane oxygen concentration of 4.3 wt %) as epoxy modified fatty acid alkyl ester were put into a ceramic pot (inner volume of 600 ml), a zirconia ball (ball diameter 1 mm) was put into the ceramic pot so as to have the volume filling rate of 85%, and the dispersion was performed for 24 hours at the rotation speed of 230 rpm of a table-type pot mill. Thereby, an liquid developer was obtained.

In the liquid developer, the Dv (50) of the toner particles was 1.95 μm. In addition, the 50% volume particle diameter Dv (50) [μm] of the obtained toner particles were measured with MicroTrack MT-3000 (Nikkiso Co., Ltd.). Moreover, particle diameters of particles obtained in examples and comparative examples to be described below were measured in the same manner.

Furthermore, the viscosity of the obtained liquid developer was 50 mPa·s at 25° C. In addition, except for the changes to a magenta-based pigment of Pigment Red 238 (made by Sanyo Color Works, Ltd.), a yellow-based pigment of Pigment Yellow 180 (made by Clariant), and a black-based pigment of Carbon Black (made by Degussa AG, Printex L) instead of a cyan-based pigment, a magenta-based liquid developer, a yellow-based liquid developer, and a black-based liquid developer were prepared in the same manner as above.

Examples 2 to 8

Liquid developer corresponding to each color was prepared in the same manner as in Example 1 above except that the kinds and content amount of the components constituting the insulating liquid were the same as those in Table 1.

Example 9

Liquid developer corresponding to each color was prepared in the same manner as in Example 1 above except that rosin modified polyester resin (made by Arakawa Chemical Industries, Ltd., the trade name of "TFS-015", the acid value of 11.8 mgKOH/g, the softening point of 79° C., the weight-average molecular weight of 1300) was used as rosin-based resin.

Example 10

Preparation of Master Batch as Coloring Agent

First, as resin materials, 48 parts by weight of polyester resin (the acid value of 10 mgKOH/g, the glass transition point (Tg) of 55° C., and the softening point of 107° C.), and 12 parts by weight of rosin modified maleic resin (made by Arakawa Chemical Industries, Ltd., the trade name of "Malkyd No. 1", the acid value of 25 mgKOH/g or less, the softening point of from 120 to 130, and the weight-average molecular weight of 3100) were prepared.

Next, a mixture (mass ratio of 50:50) of the resin materials and a cyan-based pigment (made by Dainichiseika Color & Chemicals Mfg. Co., Ltd., 15:3 of pigment blue) as a coloring agent was prepared. Each of the components was mixed by using the 20 L henschel mixer to obtain a raw material for preparing a toner.

Next, the raw material (mixture) was kneaded by using a biaxial kneading extruder. Then, the kneaded material extruded from the extruding hole of the biaxial kneading extruder was cooled.

The kneaded material cooled as above was coarsely grounded to make a master batch as a coloring agent having an average diameter of 1.0 mm or less. A hammer mill was used for the coarse-grinding of the kneaded material.

Preparation of Toner Particle 15 parts by weight of the master batch as a coloring agent, 68 parts by weight of the polyester resin, and 17 parts by weight of the rosin modified maleic resin were kneaded by using the biaxial kneading extruder. Then, the kneaded material extruded from the extruding hole of the biaxial kneading extruder was cooled. The obtained kneaded material was ground with the hammer mill to make the ground material into toner particles.

Dispersion in Insulating Liquid Process 60 parts by weight of the toner particles obtained in the above method, 144 parts by weight of epoxidized soy bean oil (made by Adeka Corporation, the trade name of "Adekacizer O-130P", the oxirane oxygen concentration of 6.9 wt %) obtained by oxidizing soy bean oil with peracetic acid, as an insulating liquid, and 96 parts by weight of epoxidized canola oil fatty acid 2-ethylhexyl were put into a wide-mouth bottle made of propylene, 300 parts by weight of ϕ3 glass beads were put to the wide-mouth bottle made of propylene, and the dispersion was performed for 90 minutes with a rocking mill RM-05S (made by Seiwa Giken Co., Ltd.) setting the inverter frequency of 52 Hz. Then, the glass beads were removed and dust and coarse particles in the obtained liquid were removed with a sieve (the mesh size of 150 micron) made of SUS to obtain a liquid developer.

In the obtained liquid developer, the Dv (50) of the toner particles was 4.92 μm. In addition, the viscosity of the obtained liquid developer was 60 mPa·s at 25° C. Furthermore, except for the changes to a magenta-based pigment of Pigment Red 238 (made by Sanyo Color Works, Ltd.), a yellow-based pigment of Pigment Yellow 180 (made by Clariant), and a black-based pigment of Carbon Black (made by Degussa AG, Printex L) instead of a cyan-based pigment, a magenta-based liquid developer, a yellow-based liquid developer, and a black-based liquid developer were prepared in the same manner as above.

Comparative Example 1

A liquid developer corresponding to each color was prepared in the same manner as in Example 1 except that liquid paraffin (made by Cosmo Oil Co., Ltd., the trade name of "Cosmo White P-70) was used instead of epoxidized canola oil fatty acid 2-ethylhexyl and the surface modification was performed with polyethyleneimine.

Comparative Example 2

A liquid developer corresponding to each color was prepared in the same manner as in Example 1 except that a mixed liquid of 120 parts by weight of canola oil (made by Nisshin Oillio Group Ltd., the trade name of "High-oleic Canola Oil") and 80 parts by weight of soy bean oil fatty acid methyl obtained by an ester exchange reaction of soy bean oil and methanol was used as an insulating liquid and the surface modification with polyethyleneimine was not performed.

The compositions of the liquid developer of Examples and Comparative Examples described above are shown in Table 1. In addition, in Table 1, each component is abbreviated as follows: polyester resin by PEs; rosin modified maleic resin by RM; rosin modified polyester resin by RPES; epoxidized canola oil fatty acid 2-ethylhexyl by A; epoxidiaed canola oil fatty acid isobutyl (made by Adeka Corporation, the trade name of "Adekacizer D-55", the oxirane oxygen concentration of 4.8 wt %) by B; epoxidized soy bean oil fatty acid stearyl (made by Adeka Corporation, the trade name of "Adekacizer D-178", the oxirane oxygen concentration of 8.2 wt %) by C; epoxidized methyl linolenate (the oxirane oxygen concentration of 24.6 wt %) by D; canola oil by E, epoxy modified soy bean oil obtained by oxidizing the soy bean oil with peracetic acid by F; liquid paraffin (Cosmo Oil Co., Ltd., the trade name of "Cosmo White P-70") by G; and soy bean oil fatty acid methyl by H. In addition the surface modification with polyethyleneimine was abbreviated by PEI processing.

2. Evaluation

The liquid developer obtained as above was evaluated as follows.

2.1. Fixing Strength

An image with a predetermined pattern by the liquid developer obtained in Examples and Comparative Examples described above was formed on a recording paper (made by Seiko Epson Corporation, high-quality paper of LPCPPA4) by using the image forming apparatus shown in FIGS. 1 and 2. Then, heat fixing was performed at the feeding speed of the recording paper of 320 mm/sec, pressure by a pressure roller of 4 kgf, and set temperature of a heat fixing roller (fixing temperature) of 125° C.

Then, after confirming a non-offset region, the fixed image on the recording paper was rubbed twice with a rubber eraser (made by Lion Office Products Corporation, a sand eraser "LION 261-11") at the pressing load of 2.0 kgf, and the residual ratio of the image density was measured with "X-Rite model 404" made by X-Rite Inc. for the evaluation according to the standard of 5 levels as follows.

A: The residual ratio of the image density is 96% or more (very good).

B: The residual ratio of the image density is 90% or more and less than 96% (good).

C: The residual ratio of the image density is 80% or more and less than 90% (acceptable range).

D: The residual ratio of the image density is 70% or more and less than 80% (slightly bad).

E: The residual ratio of the image density is less than 70% (very bad).

Furthermore, the pressure by the pressing roller was changed to 2 kgf and the evaluation was performed in the same manner.

2.2. Preservation Stability

The liquid developer obtained in Examples and Comparative Examples was left intact for 8 months under environmental conditions of 50° C. and the relative humidity of 60%. Then, the appearance of the liquid developer was observed and the changes in viscosity, color, acid value, and electric resistance value before and after being left intact were evaluated based on the standard of 5 levels below. In addition, the

TABLE 1

| | Toner Particles | | | | | Insulating Liquid | | | | |
|---|---|---|---|---|---|---|---|---|---|---|
| | Resin Material | | | | | Epoxy Modified Fatty Acid Alkyl Ester | | | Other Component | |
| | Kind | Content Amount in Resin Material [wt %] | Kind | Content Amount in Resin Material [wt %] | PEI Processing | Kind | Content Amount in Insulating Liquid [wt %] | Oxirane Oxygen Concentration [wt %] | Kind | Content Amount in Insulating Liquid [wt %] |
| Example 1 | RM | 20 | PEs | 80 | Done | A | 40 | 4.3 | E | 60 |
| Example 2 | RM | 20 | PEs | 80 | Done | A | 30 | 4.3 | E | 70 |
| Example 3 | RM | 20 | PEs | 80 | Done | A | 20 | 4.3 | E | 80 |
| Example 4 | RM | 20 | PEs | 80 | Done | A | 50 | 4.3 | E | 50 |
| Example 5 | RM | 20 | PEs | 80 | Done | A | 100 | 4.3 | — | — |
| Example 6 | RM | 20 | PEs | 80 | Done | B | 40 | 4.8 | E | 60 |
| Example 7 | RM | 20 | PEs | 80 | Done | C | 40 | 8.2 | E | 60 |
| Example 8 | RM | 20 | PEs | 80 | Done | D | 40 | 24.6 | E | 60 |
| Example 9 | RPES | 20 | PEs | 80 | Done | A | 40 | 4.3 | E | 60 |
| Example 10 | RM | 20 | PEs | 80 | Not done | A | 40 | 4.3 | F | 60 |
| Comparative Example 1 | RM | 20 | PEs | 80 | Not done | — | — | — | E/G | 60/40 |
| Comparative Example 2 | RM | 20 | PEs | 80 | Not done | — | — | — | E/H | 60/40 |

acid value was measured based on JIS K2501. Moreover, the change in color of the liquid developer was evaluated in visual observation. Furthermore, the viscosity was measured based on JIS 28809 by using a vibro viscometer. In addition, the electric resistance value was measured by using MMAII-17B as a universal electrometer, LP-05 as an electrode for liquid, and P-618 as a shield box (made by Kawaguchi Electric Works Co., Ltd.).

A: Changes in viscosity/color/acid value/electric resistance value of the liquid developer have not been recognized at all.

B: Changes in viscosity/color/acid value/electric resistance value of the liquid developer have not almost been recognized.

C: Changes in viscosity/color/acid value/electric resistance value of the liquid developer have been slightly recognized, but are in the range of not having any problems as a liquid developer.

D: Changes in viscosity/color/acid value/electric resistance value of the liquid developer have been certainly recognized.

E: Changes in viscosity/color/acid value/electric resistance value of the liquid developer have been remarkably recognized.

2.3. Dispersion Stability

The liquid developer obtained in Examples and Comparative Examples described above was left intact for 4 months under environmental condition of the temperature from 20 to 30° C. Then the appearance of the toners in the liquid developer was confirmed in visual observation and the evaluation was performed according to the standard of 5 levels as follows.

A: The flotage and clumping/sedimentation of the toner particles have not been recognized at all.

B: The flotage and clumping/sedimentation of the toner particles have not almost been recognized.

C: The flotage and clumping/sedimentation of the toner particles have been slightly recognized, but are in the range of not having any problems as a liquid developer.

D: The flotage and clumping/sedimentation of the toner particles have been certainly recognized.

E: The flotage and clumping/sedimentation of the toner particles have been remarkably recognized.

2.4. Preservation Stability of Printed Product

An image with a predetermined pattern by the liquid developer obtained in Examples and Comparative Examples described above was formed on a recording paper (made by Seiko Epson Corporation, high-quality paper of LPCPPA4) by using the image forming apparatus shown in FIGS. 1 and 2. Then, heat fixing was performed at the feeding speed of the recording paper of 320 mm/sec, pressure by a pressure roller of 4 kgf, and set temperature of a heat fixing roller (fixing temperature) of 125° C.

The printed product obtained as above was left intact for 45 hours under the environmental condition of 60° C., and the reflected density of non-image portion thereof (white color portion) was measured with a densitometer.

A: The reflected density is 0.08 or less (good preserving property).

B: The reflected density is more than 0.08 and less than 0.12 (acceptable range).

C: The reflected density is more than 0.12 (bad preserving property).

2.5. Development Efficiency

A liquid developer layer by the liquid developer obtained in Examples and Comparative Examples described above was formed on a developing roller of the image forming apparatus by using the apparatus shown in FIGS. 1 and 2. Next, the electric potential of the developing roller surface was 300 V, and the electric potential of the photoreceptors surface was uniformly charged with 500 V. The photoreceptors were exposed to light, the charges of the photoreceptors surface were attenuated, and then the surface electric potential was set to 50 V. The toner particles on the developing roller and the toner particles on the photoreceptor after the liquid developer layer passes through between the photoreceptor and the developing roller were picked up with tapes. Each tape used for the picking was attached on the recording paper, and the concentration of the toner particles on each tape was measured. After the measurement, a value, which was obtained by dividing the concentration of the toner particles picked on the photoreceptor by the sum of the concentration of the toner particles picked on the photoreceptor and the concentration of the toner particles picked on the developing roller, was multiplied by 100 and the result was obtained as the development efficiency, and the evaluation was performed based on the standard of 5 levels as follows.

A: The development efficiency is 95% and more, which is particularly excellent.

B: The development efficiency is 90% and more and less than 95%, which is excellent.

C: The development efficiency is 80% and more and less than 90%, which has no practical problem.

D: The development efficiency is 50% and more and less than 80%, which is inferior.

E: The development efficiency is less than 50%, which is particularly inferior.

The result thereof is shown in Table 2.

TABLE 2

| | Fixing Strength | | Preservation | | | |
|---|---|---|---|---|---|---|
| | Pressure 4 kgf | Pressure 2 kgf | Preservation Stability | Dispersion Stability | Stability of Printed Product | Development Efficiency |
| Example 1 | A | A | A | A | A | A |
| Example 2 | A | B | B | A | A | A |
| Example 3 | A | C | C | B | A | B |
| Example 4 | A | A | B | B | A | B |
| Example 5 | A | A | B | C | A | A |
| Example 6 | A | A | A | A | A | A |
| Example 7 | A | A | B | A | A | A |
| Example 8 | A | A | B | A | B | B |
| Example 9 | A | A | A | A | A | A |
| Example 10 | A | B | A | C | B | C |
| Comparative Example 1 | E | E | D | E | B | E |

TABLE 2-continued

| | Fixing Strength | | | | Preservation | |
|---|---|---|---|---|---|---|
| | Pressure 4 kgf | Pressure 2 kgf | Preservation Stability | Dispersion Stability | Stability of Printed Product | Development Efficiency |
| Comparative Example 2 | D | E | E | D | C | E |

As evident in Table 2, the liquid developer of the invention has been excellent in the fixing strength and preservation stability. In addition, the liquid developer of the invention has had the toner particles excellent in the dispersion stability, and the preservation stability and development efficiency of the printed product. On the contrary, the liquid development of Comparative Examples failed to obtain satisfactory results.

What is claimed is:

1. A liquid developer, comprising:

toner particles having a surface modified with polyalkyleneimine; and an insulating liquid containing an epoxy modified fatty acid alkyl ester, wherein the polyalkyleneimine modifying groups and the epoxy modified fatty acid alkyl ester interact to make a stable dispersion of the toner particles in the epoxy modified fatty acid alkyl ester, and wherein the toner particles modified with polyalkyleneimine and the epoxy modified fatty acid alkyl ester infiltrate into a recording medium to improve fixing strength of the toner particles to the recording medium.

2. The liquid developer according to claim 1, wherein the concentration of an oxirane oxygen of the epoxy modified fatty acid alkyl ester is from 1 to 25%.

3. The liquid developer according to claim 1, wherein the epoxy modified fatty acid alkyl ester is composed of an epoxy modified fatty acid component having a carbon number of 6 to 22, and an alcohol component having a carbon number of 2 to 18.

4. The liquid developer according to claim 1, wherein the weight-average molecular weight of the polyalkyleneimine is from 10,000 to 70,000.

5. The liquid developer according to claim 1, wherein the polyalkyleneimine is a polyethyleneimine.

6. The liquid developer according to claim 1, wherein the toner particles contain a resin material including a rosin-based resin.

7. An image forming method, comprising:

developing images by using a plurality of liquid developers having different colors to form a plurality of monochromatic images corresponding to the plurality of liquid developers;

transferring the plurality of monochromatic images corresponding to each color to a recording medium to form an unfixed toner image thereon by superimposing the plurality of monochromatic images; and fixing the unfixed toner image on the recording medium;

wherein the liquid developers comprise:

toner particles having a surface modified with polyalkyleneimine; and an insulating liquid containing an epoxy modified fatty acid alkyl ester, wherein the polyalkyleneimine modifying groups and the epoxy modified fatty acid alkyl ester interact to make a stable dispersion of the toner particles in the epoxy modified fatty acid alkyl ester, and wherein the toner particles modified with polyalkyleneimine and the epoxy modified fatty acid alkyl ester infiltrate into a recording medium to improve fixing strength of the toner particles to the recording medium.

8. The image forming method according to claim 7, wherein the fixing temperature when the unfixed toner image is to be fixed is from 80 to 160° C. during the fixing.

9. A liquid developer, comprising:

a multitude of toner particles having a surface comprised of acidic functional groups, wherein at least a portion of the acidic functional groups are modified with polyalkyleneimine; and an insulating liquid containing an epoxy modified fatty acid alkyl ester wherein the polyalkyleneimine modifying groups and the epoxy modified fatty acid alkyl ester interact to make a stable dispersion of the toner particles in the epoxy modified fatty acid alkyl ester, and wherein toner particles modified with polyalkyleneimine and the epoxy modified fatty acid alkyl ester infiltrate into a recording medium to improve fixing strength of the toner particles to the recording medium.

10. The liquid developer according to claim 9, wherein the concentration of an oxirane oxygen of the epoxy modified fatty acid alkyl ester is from 1 to 25%.

11. The liquid developer according to claim 9, wherein the epoxy modified fatty acid alkyl ester is composed of an epoxy modified fatty acid component having a carbon number of 6 to 22, and an alcohol component having a carbon number of 2 to 18.

12. The liquid developer according to claim 9, wherein the weight-average molecular weight of the polyalkyleneimine is from 10,000 to 70,000.

13. The liquid developer according to claim 9, wherein the polyalkyleneimine is a polyethyleneimine.

14. The liquid developer according to claim 9, wherein the toner particles contain a resin material including a rosin-based resin.

15. The liquid developer according to claim 9, wherein the acidic functional groups of the toner particles and the polyalkyleneimine form a covalent (amide) bond.

16. The liquid developer according to claim 9, wherein the acidic functional groups of the toner particles and the polyalkyleneimine form an ionic bond.

* * * * *